US005916280A

United States Patent [19]

Lantz

[11] Patent Number: 5,916,280

[45] Date of Patent: Jun. 29, 1999

[54] BRIEF CASE BOOK

[75] Inventor: Paul D. Lantz, Kingston, Pa.

[73] Assignee: A. Rifkin Co., Wilkes-Barre, Pa.

[21] Appl. No.: 09/121,724

[22] Filed: Jul. 24, 1998

[51] Int. Cl.[6] ..... E05B 67/38

[52] U.S. Cl. ..... 70/68; 70/63; 281/29

[58] Field of Search ..... 190/903, 901; 70/63, 67, 68; 281/29; 402/70, 73–77

[56] References Cited

U.S. PATENT DOCUMENTS

| | | | |
|---|---|---|---|
| 1,759,283 | 5/1930 | Schmidt | 70/68 |
| 1,950,415 | 3/1934 | Rifkin | 70/68 |
| 2,079,817 | 5/1937 | Schade et al. | 129/1 |
| 2,115,993 | 5/1938 | Kranhold | 281/29 |
| 2,183,121 | 12/1939 | Levine | 70/68 |
| 2,502,275 | 3/1950 | Perlin | 150/1.6 |
| 2,778,397 | 1/1957 | Carrasco | 150/1.6 |
| 3,141,536 | 7/1964 | Fulton | 70/68 X |
| 3,759,073 | 9/1973 | Rifkin | 70/68 |
| 3,973,419 | 8/1976 | Atkinson | 70/68 |
| 4,062,207 | 12/1977 | Bonner | 70/68 |
| 4,112,990 | 9/1978 | Anderson | 70/68 X |
| 4,817,769 | 4/1989 | Saliba | 70/68 X |

*Primary Examiner*—Suzanne Dino Barrett
*Attorney, Agent, or Firm*—Michael Ebert

[57] ABSTRACT

A high-security brief case book in which a case is integrated with a loose-leaf binder whose loose-leaf sheets are he pages of the book. The case is defined by front and rear covers of flexible material such as leather, whose inner edges are hinged to opposing edges of a flat spine. Mounted on the spine is a holder having a series of rings adapted to engage the loose-leaf sheets. The upper end of the holder is spaced from the corresponding end of the spine to provide a site on which is anchored a key-operated locking mechanism whose keyhole lies in a plane normal to the plane of the flat spine whereby only the keyhole is exposed when the book is closed. The lower end of the holder is spaced from the corresponding end of the spine to provide a site on which is secured the leading end of a slide fastener whose trailing end is adjacent the locking mechanism. When the covers are superposed to close the case, the slider of the fastener is then able to run parallel to the free edges of the covers toward the trailing end of the slide fastener where the slider is then engaged by the clamping jaws of the locking mechanism whereby access to the interior of the case is restricted to those holding a key to the locking mechanism.

5 Claims, 3 Drawing Sheets

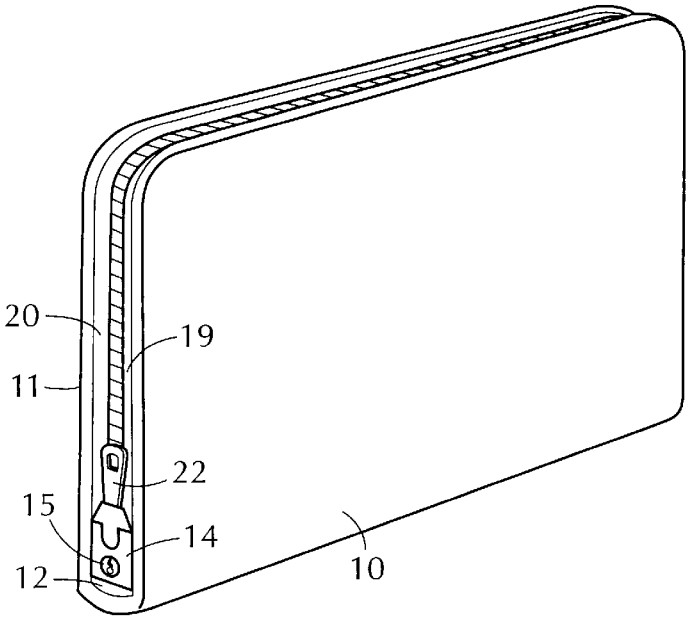
FIG. 1
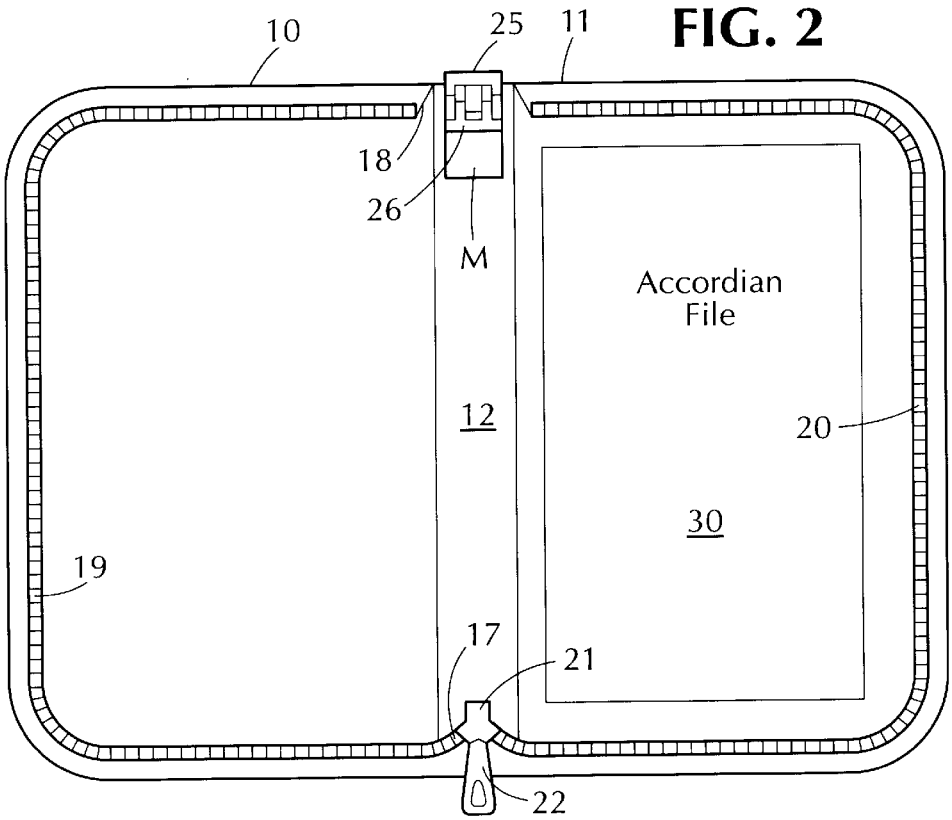
FIG. 2
FIG. 2A
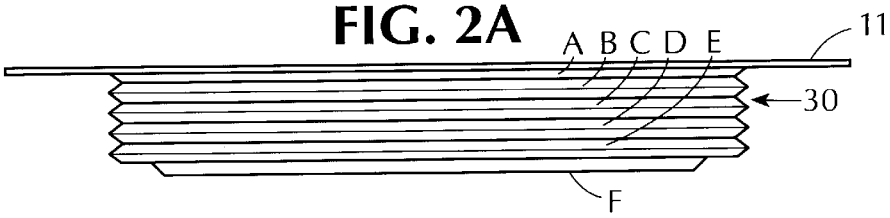

BRIEF CASE BOOK

BACKGROUND OF INVENTION

1. Field of Invention

This invention relates generally to a brief case integrated with a loose-leaf binder to form a brief case book, and more particularly to a high-security brief case book having front and rear covers which when superposed to close the case are then joined together by a slide fastener whose slider is engageable by the clamping jaws of a key-operated locking mechanism whereby access to the book is restricted to those holding a key to the mechanism.

2. Status of Prior Art

A brief case is a flat rectangular bag made of flexible material, such as leather or fabric, designed to carry legal briefs or other papers. A conventional brief case is provided with a slide fastener or zipper which when unzipped provides access to the interior of the case.

A standard loose-leaf binder is provided with front and rear panels hinged to opposing edges of a holder having a series of rings thereon operated by a finger key which opens the rings to receive the punched holes of loose-leaf paper sheets.

It is known to integrate a loose-leaf holder with a brief case to create a book whose pages are loose-leaf sheets. Thus the Kranhold patent 2,115,993 discloses a brief case book in which the leather covers of the case are hinged which a backbone on which rings are mounted to engage loose-leaf sheets. The Kranhold book is provided with a zipper to fasten the covers together, the slider of the zipper being engaged by the shackle of a lock that dangles from the book. Similar brief case books whose pages are loose-leaf sheets are shown in the Perlin patent 2,502,275, the Carrasco patent 2,778,397 and the Schade et al. patent 2,079,817.

As pointed out in the Schade et al. patent, when a brief case book is closed, it then has the appearance of a conventional brief case and one is not then aware that within the case is a loose-leaf binder holding the pages of a book. In the context of the present invention, the advantage of a brief case book is not only that the book looks like a brief case, but also that the brief case can be used to carry not only loose-leaf sheets, but other items useful to the holder of the book.

Thus should the director of a major corporation be scheduled to make a presentation to company officers in the company's board room, in the brief case book brought by the director to the board room are the notes he requires for the presentation, these being typed on the loose-leaf sheets. Also stored in the brief case book are pens and other small items the director may need in the course of his presentation.

The main concern of the present invention is with security, for should the contents of the brief case book carried by the director be highly confidential, it is vital that access to the book be denied to all personnel other than the director or whomever else is authorized to possess a key that can unlock the book.

While the Kranhold brief case book is provided with a key-operated lock that engages the zipper slider of the zipper and dangles from the book, this lock affords a low measure of security, for instead of using a key, it is possible to twist the lock to decouple it from the zipper slider.

It is known to provide a key-operated locking mechanism for the slide fastener of a money pouch, a mail pouch or other forms of flexible containers. Among the patents disclosing such zipper-locking mechanisms are the following:

| | | |
|---|---|---|
| Hart - | 3,070,986 | - Lock Type Keeper Mechanism for a Slide Fastener |
| Rifkin - | 1,950,414 | - Lock for Separable Fasteners |
| Rifkin - | 3,759,073 | - Flexible Walled Security Container |

While these patents disclose various types of key-operated looking mechanisms for zipper-type slide fasteners, the arrangements disclosed therein are unsuitable for a brief case book.

SUMMARY OF INVENTION

In view of the foregoing, the main object of this invention is to provide a brief case integrated either with a loose-leaf binder or an accordion file to form a brief case book whose pages are loose sheets, the book including a slide fastener and a locking mechanism therefor, affording a high-degree of security.

A significant advantage of a brief case book in accordance with the invention is that access to the book is limited to holders of a key for a locking mechanism housed within the book so that it cannot be twisted off or otherwise detached from therefrom.

More particularly, an object of this invention is to provide a brief case book in which the loose-leaf binder and the loose-leaf sheets held thereby do not fully occupy the interior of the book, the residual interior space being available to store useful items.

Also an object of the invention is to provide a brief case book that has the appearance of a high-quality brief case, yet can be mass produced at relatively low cost.

Briefly stated, these objects are attained by a high-security brief case book in which a case is integrated with a loose-leaf binder whose loose-leaf sheets are the pages of the book. The case is defined by front and rear covers of flexible material such as leather, whose inner edges are hinged to opposing edges of a flat spine. Mounted on the spine is a holder having a series of rings adapted to engage the loose-leaf sheets. The upper end of the holder is spaced from the corresponding end of the spine to provide a site on which is anchored a key-operated locking mechanism whose keyhole lies in a plane normal to the plane of the flat spine whereby only the keyhole is exposed.

The lower end of the holder is spaced from the corresponding end of the spine to provide a site on which is secured the leading end of a slide fastener whose trailing end is adjacent the locking mechanism. When the covers toward are superposed to close the case the slider of the fastener is then able to run parallel to the free edges of the covers, toward the trailing end of the slide fastener where the slider is then engaged by the clamping jaws of the locking mechanism whereby access to the interior of the case is restricted to those holding a key to the locking mechanism.

In another version of the brief case book, instead of a loose leaf binder there is attached to the rear cover of the case an accordion file having multiple pockets to accommodate the loose sheets of a book or other papers.

BRIEF DESCRIPTION OF DRAWING

For a better understanding of the invention, as well as further features thereof, reference is made to the detailed description thereof to be read in connection with the annexed drawings wherein:

FIG. 1 is a perspective view of a brief case book in accordance with the invention having a slide fastener;

FIG. 2 shows a first embodiment of the brief case book having incorporated therein an accordion file whose pockets are adapted to receive loose sheets; the book being shown in its wide-open state;

FIG. 2A is an end view of the accordion file when in an expanded state;

DETAILED DESCRIPTION OF INVENTION

First Embodiment

Figure 3:
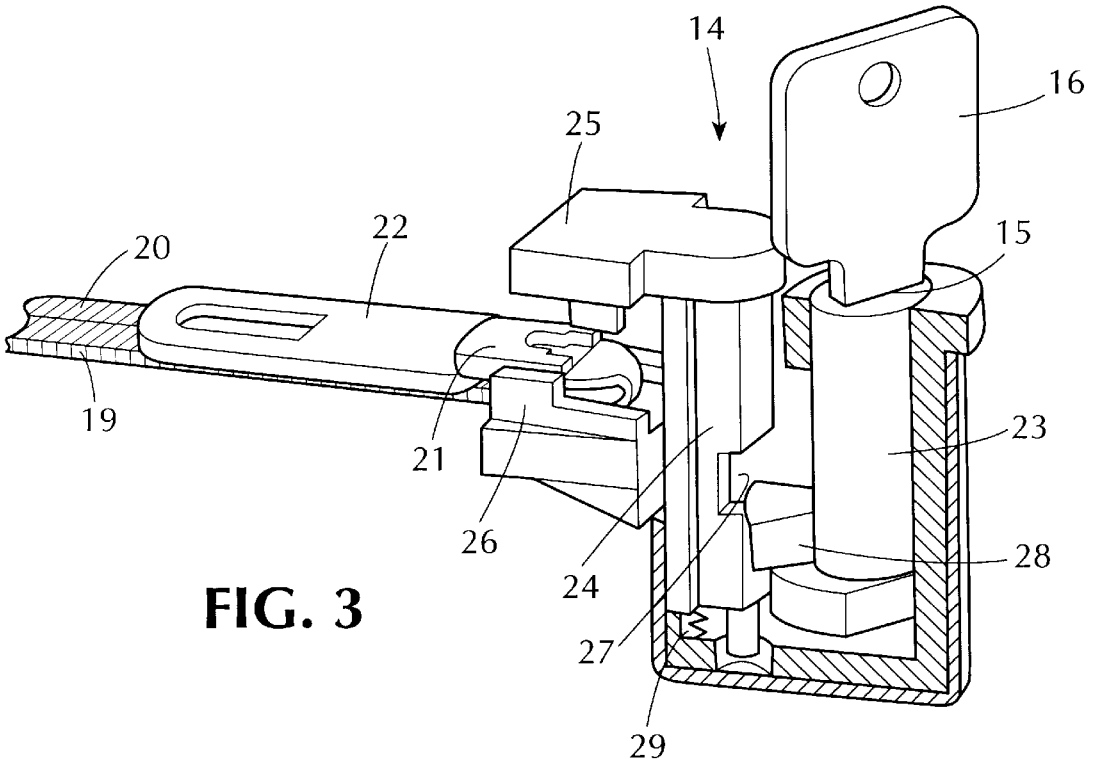
FIG. 3 is a perspective view of the key-operated locking mechanism included in the brief case book, the mechanism being unlocked by a key to open its clamping jaws.

Referring now to FIGS. 1, 2 and 2A, shown in these figures is a brief case book in accordance with the invention, the case of which includes a generally rectangular front panel 10 and a like rear panel 11. These panels are preferably made of leather, high-grade synthetic plastic or other suitable flexible material. The inner edges of panels 10 and 11 are hinged to opposing edges of a rigid, flat spine 12 to form the covers of a book.

In practice, front and rear covers 10 and 11 may be made of a single large rectangular sheet of leather, with a rigid plastic spine 12 attached to the inner surface of this sheet at its midsection. In this way the exterior of the case is formed entirely of leather.

Anchored on the upper end of spine 12 is a key-operated locking mechanism 14 (shown separately in FIGS. 3 and 4), having a key hole 15 which lies in a plane normal to the plane of flat spine 13. Hence when the brief case is closed, as shown in FIGS. 1 and 5, only the key hole is exposed to receive a key 16, the locking mechanism being then housed within the closed brief case.

The case is provided with a slide fastener of the zipper type whose leading end 17 is secured to a site at the lower end of spine 12. The slide fastener is composed of a pair of cooperating fabric tapes 19 and 20, each having a row of metal teeth secured to the outer edge of the tape. These teeth are interengaged by a slider 21 coupled to a pull tag 22. The inner edge of tape 19 is sewn or otherwise joined to the free edge of front cover 10 which run from the lower end to the upper end of spine 13. Similarly, the inner edge of tape 20 is joined to the free edges of rear cover 11. The trailing end 18 of the slide fastener, as shown in FIG. 2, is adjacent the locking mechanism 14.

When therefore front cover 10 is folded over rear cover 11 to close the case, and slider 21 is pulled by its tag 22 to interengage the metal teeth of the tapes, the moving slider then runs parallel to the free edges o the covers until it reaches trailing end 18 of the fastener, at which position where it can be clamped by the jaws of the locking mechanism 14, thereby locking the case.

Figure 4:
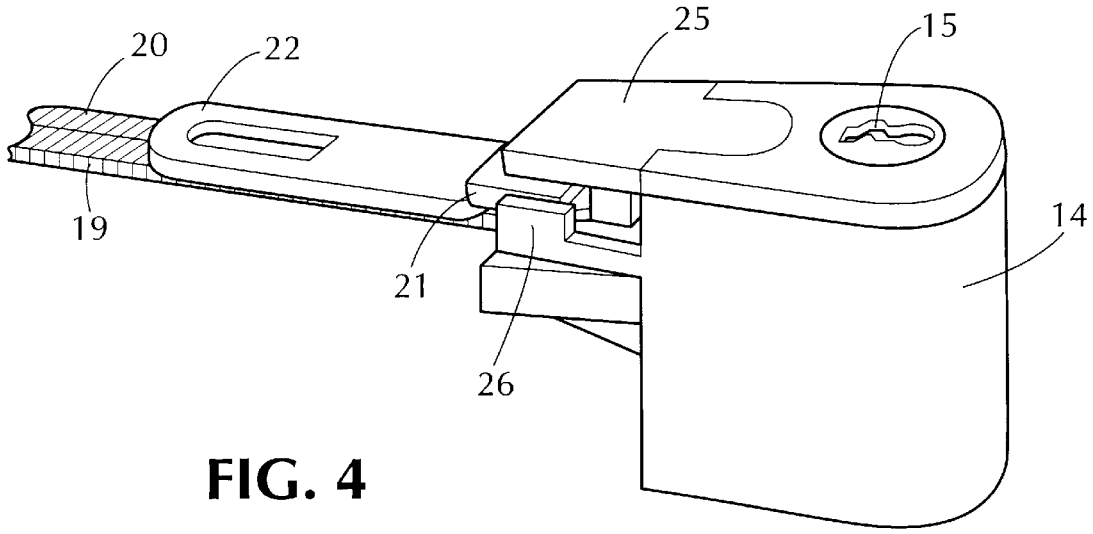
FIG. 4 shows the locking mechanism when it is operated to cause the clamp the slider of the slide fastener.
Figure 5:
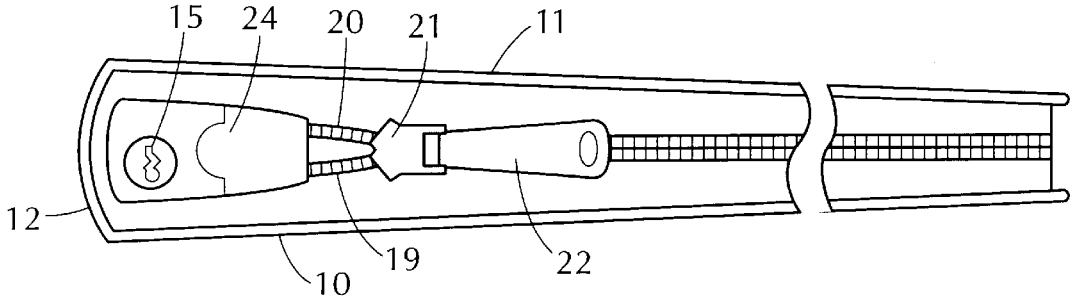
FIG. 5 is an end view of the brief case book which shows the slider the slide fastener just before it is clamped b the jaws of the locking mechanism.

As illustrated in FIGS. 3 and 4, locking mechanism 14 includes a barrel 23 at whose upper end is the key hole 15. When, as shown in FIG. 3, key 16 is inserted in key hole 15, one can by turning the key then turn barrel 23. Barrel 23 cooperates with a spring-loaded plunger 25 which is normally maintained in a raised state by a spring 29 underlying the plunger. Associated with plunger 24 is a pair of locking jaws consisting of an upper jaw 25 welded to the upper end of plunger 24 and adapted to engage a fixed lower jaws 26 when the plunger is depressed.

As shown in FIG. 3, when slider 24 of the slide fastener is placed between the open jaws in the open state and plunger 24 is the depressed, then, as shown in FIG. 4, the jaws act to clamp and capture the slider so that it cannot be pulled to open the zipper. Plunger 24 is provided with a notch 27 on one side thereof. When plunger 24 is in its raised position, as shown in FIG. 3, then notch 27 is placed just above a lug 28 projecting laterally from barrel 23. But when plunger 24 is depressed to clamp the slider of the fastener, and barrel 23 is then turned by the inserted key 16, lug 28 then enters notch 27 in the plunger to maintain it in its depressed state in which the slider of the fastener is clamped.

Thus when the slider is clamped by the jaws of the locking mechanism and key 16 is removed from the key hole, the case is securely locked and inaccessible except a holder of key 16. The only way to open the case is to insert the key and turn it to cause the plunger to rotate to release the plunger which is then raised by spring 29 to unclamp the slider.

In the embodiment of the brief case book shown in FIG. 2 and FIG. 2A, secured to the inner surface of rear cover 11 is an accordion file 30 having multiple pockets A to E which normally lie flat, but are expandable to accommodate the loose sheets of a book. By a book, as this term is used herein, is meant several pages sandwiched between front and rear covers, which pages need not be adhered to the spine of the book, but may be loose so that each page can be withdrawn from the book, as in a loose-leaf binder or an accordion file.

Secured to the outer pocket E of the accordion file 30 is a shallow utility pocket F to accommodate pens, a ruler and other small articles useful to the holder of the brief case book. When the accordion file and the utility pocket are fully loaded, they then expand to fully occupy the space within the brief case book.

Second Embodiment

Figure 6:
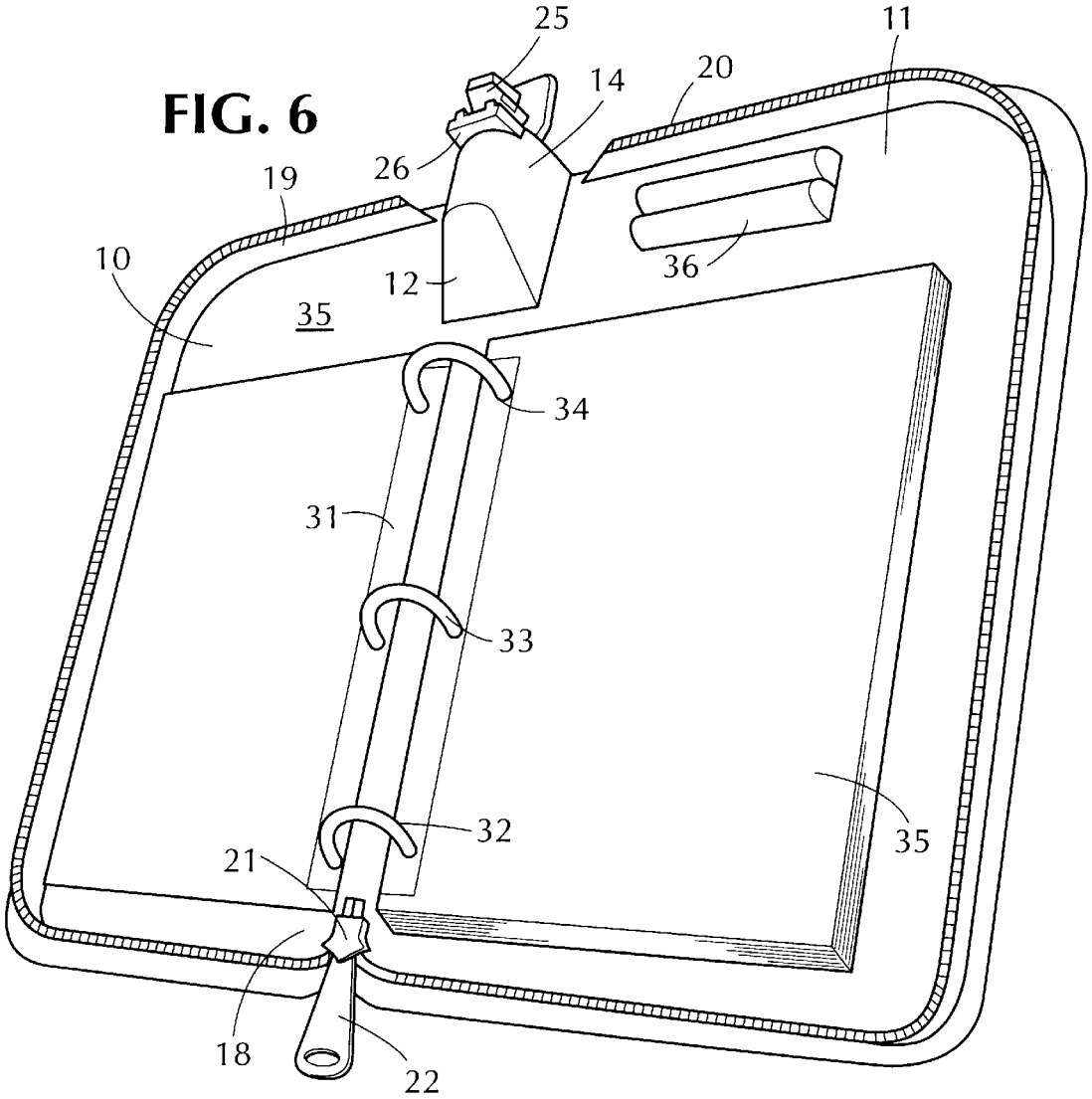
FIG. 6 shows a second embodiment of a brief case book in accordance with the invention which incorporates a loose-leaf binder; the book being shown in its wide open state.

In the embodiment of a brief case book, shown in FIG. 6, instead of an accordion file, as shown in the first embodiment, attached to spine 12 of the book to which covers 10 and 11 are hinged is a loose-leaf holder 31 provided with three rings 32, 33 and 34 for a retaining loose leaf sheets 35 which form the pages of the book. The loose leaf holder is provided with the usual finger key (not shown) which opens the rings to receive the punched holes of the loose-leaf sheets.

Locking mechanism 14 is anchored at a site on spine 12 above the upper end of loose-leaf holder 31 and is preferably encased in a plastic jacket that is riveted or otherwise joined to spine 12 so that the locking mechanism cannot be detached from the case. The leading end 18 of the slide fastener is secured to spine 12 at a site below the lower end of holder 31.

The arrangement is that within the case above the upper end of the loose leaf binder is a free utility space 32 for small articles, such as a penholder 36. The embodiment of same manner as in the first embodiment. Once locked, access thereto is denied, except to a holder of the key to the locking mechanism.

While there has been shown and described preferred embodiments of a brief case book, it will be appreciated that many changes and modifications may be made therein without, however, departing from the essential spirit thereof.

We claim:

1. A high-security brief case book comprising:

a. a book including a flat spine having an upper and a lower end, and front and rear covers formed of flexible material hinged to opposing edges of the spine, said covers having free edges which when fastened together by a slide fastener provided with a slider define a brief case to accommodate paper sheets sandwiched between the covers which constitute pages of the book;

b. a key-operated locking mechanism anchored at a site on the upper end of the spine having a key hole lying in a plane normal to that of the spine whereby when the case is closed only the key hole is exposed, said mechanism being adapted to capture the slider of the fastener; said mechanism including an upper jaw which when the mechanism is locked engages a lower jaw to clamp the slider therebetween;

c. a slide fastener having a leading end secured to a site at the lower end of the spine and a trailing end adjacent said mechanism, the slider running in a path along the free edges of the covers from the leading end to the trailing end of the fastener at which the slider can be captured by the mechanism to seal the brief case book whereby access thereto is limited to a holder of the key;

d. a loose-leaf holder mounted on said flat spine having multiple rings to retain loose leaf sheets forming the pages of said book, said holder having an upper end spaced from the corresponding end of the spine to create said site anchoring the locking mechanism and a lower end spaced from the corresponding end of the spine to create said site securing the leading end of the fastener; and e. a jacket encasing said locking mechanism and joined to said spine at the upper end of the site to prevent detachment of the mechanism.

2. book as set forth in claim 1, in which the mechanism includes a spring-biased depressible plunger having an upper end joined to said upper jaw whereby when the plunger is in a depressed state the slider is then clamped between said upper jaw and said lower jaw.

3. A brief case book as set forth in claim 2, in which the key of the mechanism when inserted in said key hole and turned, turns a barrel provided with a projecting lug which then enters a notch in said plunger to maintain the plunger in said depressed state.

4. A brief case book as set forth in claim 1, in which said covers are formed of leather.

5. A brief case book as set forth in claim 1, further including means on said rear cover above said holder to retain small articles.

* * * * *